US010366658B2

(12) United States Patent
Tani et al.

(10) Patent No.: US 10,366,658 B2
(45) Date of Patent: Jul. 30, 2019

(54) ORGANIC LIGHT EMITTING DIODE DISPLAY AND METHOD OF DRIVING THE SAME

(71) Applicant: LG DISPLAY CO., LTD., Seoul (KR)

(72) Inventors: Ryosuke Tani, Paju-si (KR); Jongjin Lim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 106 days.

(21) Appl. No.: 15/586,846

(22) Filed: May 4, 2017

(65) Prior Publication Data

US 2017/0345376 A1 Nov. 30, 2017

(30) Foreign Application Priority Data

May 31, 2016 (KR) ..... 10-2016-0067310

(51) Int. Cl.

| | |
|---|---|
| ***G09G 3/32*** | (2016.01) |
| ***G09G 3/3283*** | (2016.01) |
| ***G09G 3/3233*** | (2016.01) |
| ***G09G 3/3266*** | (2016.01) |

(52) U.S. Cl.

CPC ..... *G09G 3/3283* (2013.01); *G09G 3/3233* (2013.01); *G09G 3/3266* (2013.01); *G09G 2310/0272* (2013.01); *G09G 2310/08* (2013.01)

(58) Field of Classification Search

CPC .. G09G 3/3283; G09G 3/3266; G09G 3/3233; G09G 2310/08; G09G 2310/0272

USPC ..... 345/76, 82, 94, 212

See application file for complete search history.

(56) References Cited

U.S. PATENT DOCUMENTS

| | | | | |
|---|---|---|---|---|
| 2007/0103398 | A1* | 5/2007 | Correa | G09G 3/2946 345/63 |
| 2010/0039451 | A1* | 2/2010 | Jung | G09G 3/3611 345/690 |
| 2014/0139510 | A1* | 5/2014 | Han | G09G 3/3233 345/212 |
| 2015/0170560 | A1* | 6/2015 | Lim | G09G 3/3291 345/691 |
| 2015/0187267 | A1 | 7/2015 | Park et al. | |
| 2015/0243222 | A1 | 8/2015 | Lee | |

(Continued)

FOREIGN PATENT DOCUMENTS

| | | | |
|---|---|---|---|
| CN | 101866619 | A | 10/2010 |
| CN | 103731590 | A | 4/2014 |

(Continued)

*Primary Examiner* — Jennifer T Nguyen

(74) *Attorney, Agent, or Firm* — Birch, Stewart, Kolasch & Birch, LLP

(57) ABSTRACT

An organic light emitting diode (OLED) display is discussed. The OLED display is capable of duty driving for controlling an emission duty of an OLED in one frame. One frame for the duty driving includes a programming period, an emission period, and a non-emission period. In the programming period, a first data voltage is applied to a gate node in response to a scan signal and a reference voltage is applied to a source node in response to a sensing signal. In the non-emission period, a second data voltage is applied to the gate node in response to the scan signal. The first data voltage corresponds to input video data to be applied to a first pixel. The second data voltage corresponds to input video data to be applied to a second pixel different from the first pixel.

14 Claims, 20 Drawing Sheets

(56) References Cited

U.S. PATENT DOCUMENTS

| | | | |
|---|---|---|---|
| 2016/0055799 | A1 | 2/2016 | Eom et al. |
| 2016/0171932 | A1 | 6/2016 | Eom et al. |

FOREIGN PATENT DOCUMENTS

| | | | |
|---|---|---|---|
| CN | 103839517 | A | 6/2014 |
| CN | 103886833 | A | 6/2014 |
| CN | 104751781 | A | 7/2015 |
| CN | 104751788 | A | 7/2015 |
| CN | 105243985 | A | 1/2016 |
| KR | 10-2011-0108033 | A | 10/2011 |
| TW | I508045 | B | 11/2015 |

* cited by examiner

ORGANIC LIGHT EMITTING DIODE DISPLAY AND METHOD OF DRIVING THE SAME

This application claims the priority benefit of Korean Patent Application No. 10-2016-0067310 filed on May 31, 2016, the entire disclosure of which are hereby incorporated by reference herein for all purposes.

BACKGROUND OF THE INVENTION

Field of the Invention

The present disclosure relates to an organic light emitting diode display and a method of driving the same.

Discussion of the Related Art

An active matrix organic light emitting diode display includes organic light emitting diodes (OLEDs) capable of emitting light by themselves and has many advantages, such as a fast response time, a high emission efficiency, a high luminance, a wide viewing angle, and the like.

An OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a power voltage is applied to the anode electrode and the cathode electrode, holes passing through the hole transport layer HTL and electrons passing through the electron transport layer ETL move to the emission layer EML and form excitons. As a result, the emission layer EML generates visible light.

An organic light emitting diode display arranges pixels each including an OLED in a matrix form and adjusts a luminance of the pixels based on a grayscale of video data. Each pixel includes a driving thin film transistor (TFT) controlling a driving current flowing in the OLED based on a voltage between a gate electrode and a source electrode of the driving TFT, and at least one switching TFT programming the gate-to-source voltage of the driving TFT. Each pixel adjusts the display grayscale (luminance) by an amount of emitted light of the OLED which is proportional to the driving current.

In such an organic light emitting diode display, a duty control technique for adjusting an emission duty in one frame has been proposed in order to improve video response characteristics and low grayscale display quality.

According to a related art, a duty control technique 1, as shown in FIG. 1, divides one frame (Fn+1 or Fn+2) into an emission period Ta and a black display period Tb and writes black data according to a line sequential manner at a predetermined timing to control the black display period Tb. The black data has a data level capable of turning off a driving TFT. When the black data is applied, a driving current applied to the OLED is cut off, so that the OLED is not emitted. As a timing for writing the black data in one frame is advanced, the emission period Ta is decreased and the black display period Tb is increased. According to this duty control technique 1, an output channel potential of the data driving circuit must continuously swing from the video data level to the black data level or vice versa for black data writing. Thus, there is a problem that power consumed and heat generated in the data driving circuit are increased.

A duty control technique 2 according to a related art, as shown in FIG. 2, further includes a separate emission control TFT ET in a pixel and, and divides one frame (Fn+1 or Fn+2) into an emission period Ta and a black display period Tb as shown in FIG. 1. The duty control technique 2 turns off the emission control TFT ET according to a line sequential manner at a predetermined timing to realize the black display period Tb. The emission control TFT ET may be connected to an arbitrary position between an input terminal of a high potential driving voltage EVDD and an input terminal of a low potential driving voltage EVSS in the pixel. In FIG. 2, DT indicates a driving TFT, and SWC indicates a switching circuit connected to the driving TFT DT and the emission control TFT ET. When the emission control TFT ET is turned off, a driving current applied to the OLED is cut off, so that the OLED is not emitted. The duty control technique 2 has a problem that the pixel array configuration becomes complicated because the emission control TFT ET is added to each pixel. The duty control technique 2 has a problem that luminance distortion occurs due to a kick back effect by a parasitic capacitance when the emission control TFT ET is turned off.

SUMMARY OF THE INVENTION

Accordingly, an object of the present disclosure is to provide an organic light emitting diode display and a method of driving the same that can adjust an emission duty of an organic light emitting diode (OLED) without writing black data or providing an emission control TFT in a pixel.

In one aspect, there is provided an organic light emitting diode display capable of duty driving for controlling an emission duty of an OLED in one frame, comprising: a display panel having the OLED, a TFT for controlling a driving current flowing in the OLED depending on a voltage between a gate node and a source node, and a plurality of pixels connected to a data line, a reference line, and a gate line; a data driving circuit configured to supply a data voltage to the data line and supply a reference voltage to the reference line; and a gate driving circuit configured to generate a scan signal synchronized with the data voltage and a sensing signal synchronized with the reference voltage and supply the generated scan signal and sensing signal to the gate line, wherein one frame for the duty driving includes a programming period for setting the voltage between the gate node and the source node to correspond the driving current, an emission period in which the OLED emits light depending on the driving current, and a non-emission period in which the emission of the OLED stops, in the programming period, a first data voltage is applied to the gate node in response to the scan signal and the reference voltage is applied to the source node in response to the sensing signal, in the non-emission period, a second data voltage is applied to the gate node according to the scan signal, wherein the first data voltage corresponds to input video data to be applied to a first pixel, and wherein the second data voltage corresponds to input video data to be applied to a second pixel different from the first pixel.

In another aspect, there is provided a method of driving an OLED, a TFT for controlling a driving current flowing in the OLED depending on a voltage between a gate node and a source node, and a plurality of pixels connected to a data line, a reference line, and a gate line, the organic light emitting diode display capable of duty driving for controlling an emission duty of the OLED in one frame, the method comprising: supplying a data voltage to the data line and supplying a reference voltage to the reference line; and generating a scan signal synchronized with the data voltage and a sensing signal synchronized with the reference voltage and supplying the generated scan signal and sensing signal to the gate line, wherein one frame for the duty driving includes a programming period for setting the voltage between the gate node and the source node to correspond the driving current, an emission period in which the OLED emits light depending on the driving current, and a non-emission period in which the emission of the OLED stops, in the programming period, a first data voltage is applied to the gate node in response to the scan signal and the reference voltage is applied to the source node in response to the sensing signal, in the non-emission period, a second data voltage is applied to the gate node in response to the scan signal, wherein the first data voltage corresponds to input video data to be applied to a first pixel, and wherein the second data voltage corresponds to input video data to be applied to a second pixel different from the first pixel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
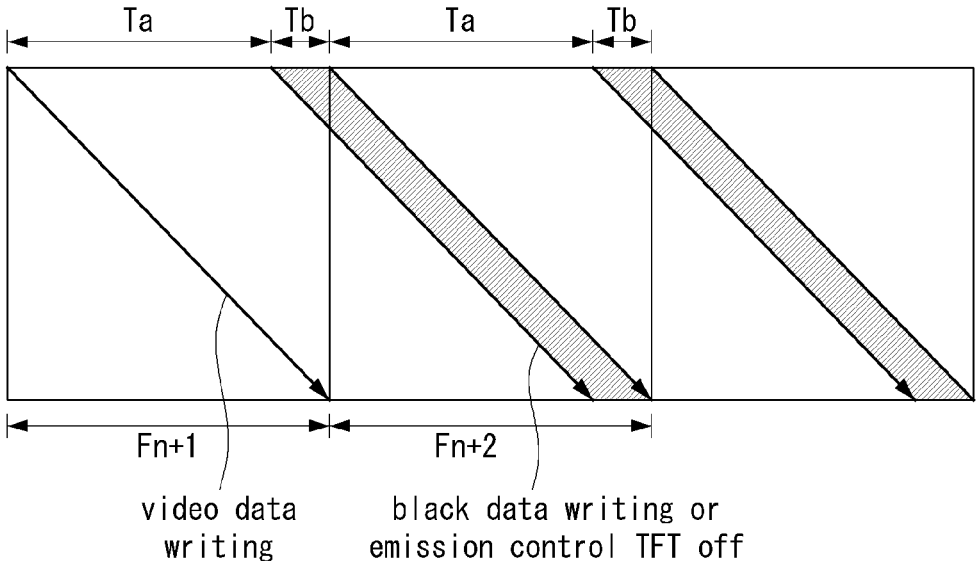
FIG. 1 (RELATED ART)
FIG. 1 is a diagram illustrating a duty control technique for controlling emission duty by writing black data or turning off an emission control TFT in a pixel according to a related art.
Figure 2:
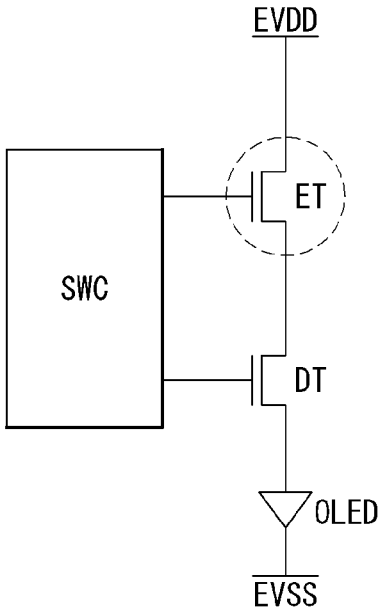
FIG. 2 (RELATED ART)
FIG. 2 is a diagram illustrating a pixel configuration further including an emission control TFT for implementing a duty control technique according to a related art.

Advantages and features of the present disclosure and methods for accomplishing the same will become apparent with reference to the embodiments described in detail below with reference to the accompanying drawings. However, the present disclosure is not limited to embodiments disclosed below, and may be implemented in various forms. These embodiments are provided so that the present disclosure will be exhaustively and completely described, and will fully convey the scope of the present disclosure to those skilled in the art to which the present disclosure pertains. The present disclosure is only defined by the scope of the claims.

Shapes, sizes, ratios, angles, number, and the like illustrated in the drawings for describing embodiments of the present disclosure are merely exemplary, and the present disclosure is not limited thereto. Like reference numerals designate like elements throughout the description. In the following description, when a detailed description of well-known functions or configurations related to this document is determined to unnecessarily cloud a gist of the invention, the detailed description thereof will be omitted. In the present disclosure, when the terms "include", "have", "comprised of", etc. are used, other components may be added unless "~ only" is used. A singular expression can include a plural expression as long as it does not have an apparently different meaning in context.

In the explanation of components, even if there is no separate description, it is interpreted as including an error range.

In the description of position relationship, when a structure is described as being positioned "on or above", "under or below", "next to" another structure, this description should be construed as including a case in which the structures contact each other as well as a case in which a third structure is disposed therebetween.

The description of a layer "on" another element or another layer should be construed as including a case in which an element or a layer is directly on another element or another layer and a case in which a third element or a third layer is interposed between the elements or the layers.

The terms "first", "second", etc. may be used to describe various components, but the components are not limited by such terms. The terms are used only for the purpose of distinguishing one component from other components. For example, a first component may be designated as a second component without departing from the scope of the present invention.

Like reference numerals designate like elements throughout the description.

The sizes and thicknesses of the respective components shown in the drawings are shown for convenience of explanation, and the present disclosure is not necessarily limited to the size and thickness of the illustrated arrangement.

The features of various embodiments of the present disclosure can be partially combined or entirely combined with each other, and can be technically interlocking-driven in various ways. The embodiments can be independently implemented, or can be implemented in conjunction with each other.

Various embodiments of the present disclosure will be described in detail below with reference to the accompanying drawings.

Hereinafter, preferred embodiments of the present disclosure will be described with reference to FIGS. 3 to 17.

Figure 3:
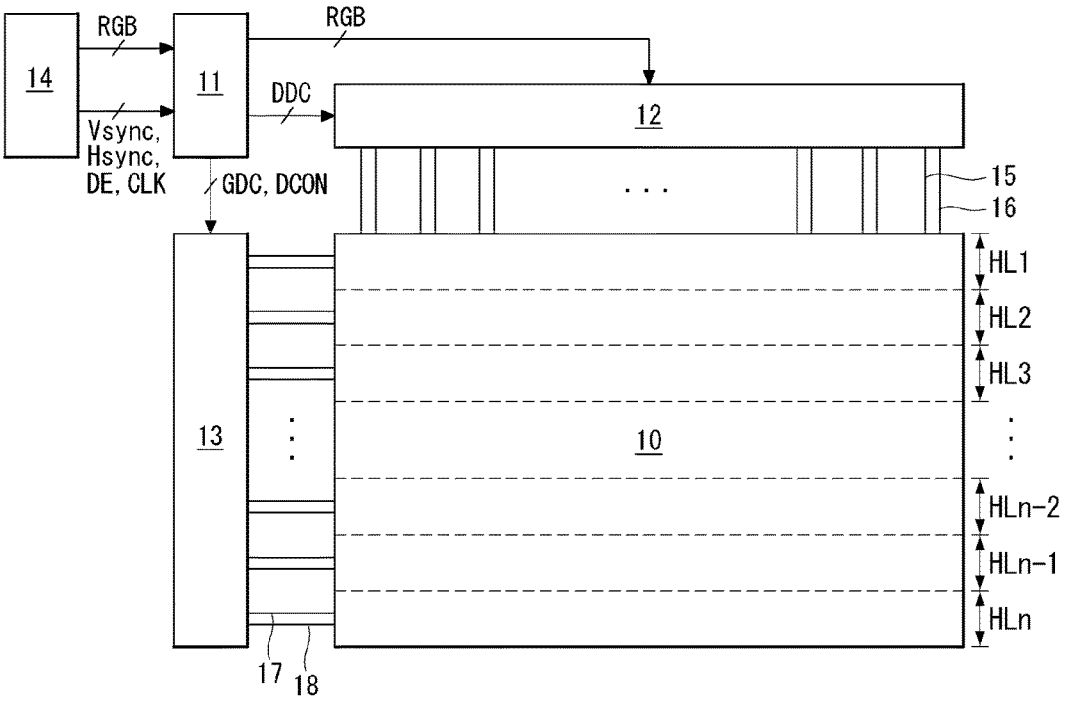
FIG. 3 is a diagram illustrating an organic light emitting diode display according to an embodiment of the present disclosure.

FIG. 3 illustrates an organic light emitting diode display according to an embodiment of the present disclosure. All the components of the organic light emitting diode display according to all embodiments of the present disclosure are operatively coupled and configured.

Referring to FIG. 3, the organic light emitting diode display according to an embodiment of the present disclosure includes a display panel 10, a timing controller 11, a data driving circuit 12, and a gate driving circuit 13.

In the display panel 10, a plurality of data lines 15, reference lines 16 and a plurality of gate lines 17 and 18 are intersected, and pixels are arranged in a matrix form for each of the intersection areas and constitute a pixel array. The pixel array is provided with a plurality of horizontal pixel lines HL1 to HLn. One horizontal pixel line includes a plurality of pixels arranged adjacent to each other along a horizontal direction.

The gate lines 17 and 18 may include first gate lines 17 to which a scan signal is applied and second gate lines 18 to which a sensing signal is applied. Each pixel may be connected to one of the data lines 15, to one of the reference lines 16, to one of the first gate lines 17, and to one of the second gate lines 18. Each pixel includes an organic light emitting diode (OLED) and a driving thin film transistor (TFT). Each pixel is capable of duty driving for controlling an emission duty of the OLED in one frame.

The pixel is supplied with a high potential driving voltage (EVDD) and a low potential driving voltage (EVSS) from a power supply block. TFTs constituting the pixel may be implemented as a p-type, an n-type, or a hybrid type. Further, a semiconductor layer of the TFTs constituting the pixel may include amorphous silicon, polysilicon, or an oxide.

The data driving circuit 12 converts input video data RGB into data voltages under a control of the timing controller 11 and supplies the data voltages to the data lines 15. The data driving circuit 12 generates reference voltages under a control of the timing controller 11 and supplies the reference voltages to the reference lines 16.

Under a control of the timing controller 11, the gate drive circuit 13 generates scan signals synchronized with the data voltages, supplies the scan signals to the first gate lines 17, and generates sensing signals synchronized with the reference voltages, supplies the sensing signals to the second gate lines 18. The gate driving circuit 13 may be embedded in a non-display area of the display panel 10 or may be bonded to the display panel 10 in a form of an IC. The gate driving circuit 13 constitutes a scan signal for duty driving in one frame as a first scan pulse and a second scan pulse and successively supplies the first scan pulse and the second scan pulse to the same pixel for one frame. The gate driving circuit 13 may constitute a sensing signal for duty driving in one frame as only a first sensing pulse and supply the first sensing pulse to the pixel in synchronization with the first scan pulse. The gate driving circuit 13 may constitutes a sensing signal for duty driving in one frame as a first sensing pulse and a second sensing pulse and supply the first sensing pulse in synchronization with the first scan pulse to the pixel, and then supply the second sensing pulse subsequent to the second scan pulse to the pixel.

The timing controller 11 may receive input video data RGB from a host system 14 through an interface circuit, and transmit the video data RGB to the data driving circuit 12 through various interface methods such as mini-LVDS, and the like.

The timing controller 11 receives timing signals such as a vertical synchronization signal Vsync, a horizontal synchronization signal Hsync, a data enable signal DE and a dot clock CLK, and the like from the host system 14, and generates control signals for controlling operation timings of the data driving circuit 12 and the gate driving circuit 13. The control signals include a gate timing control signal GDC for controlling an operation timing of the gate driving circuit 13, a source timing control signal DDC for controlling an operation timing of the data driving circuit 12, and a duty control signal DCON for controlling the emission duty of the OLED.

The duty control signal DCON is a signal for controlling an interval between the first scan pulse and the second scan pulse of the scan signal. The duty control signal DCON may be a signal for controlling the interval between the first scan pulse and the second scan pulse of the scan signal and an interval between the first sensing pulse and the second sensing pulse of the sensing signal. The duty control signal DCON is a signal which is completely independent of writing black data or turning on/off the emission control TFT in the pixel as in the case. The present disclosure can adjust a non-emission period in which the emission of the OLED stops in one frame by appropriately controlling the scan signal or the scan signal and the sensing signal without programming the black data capable of turning off the driving TFT.

The timing controller 11 controls the operation of the gate driving circuit 13 so that duty driving is performed only when the video data variation between neighboring frames is large. Therefore, the timing controller 11 can minimize power consumption due to duty driving. During the duty driving, when the average picture level of the video data RGB is equal to a preset reference value, the timing controller 11 may generate a duty control signal DCON to maintain the interval between the first scan pulse and the second scan pulse of the scan signal applied to the same pixel at a default value. When the average picture level of the video data RGB is larger than a preset reference value, the timing controller 11 may generate a duty control signal DCON to increase the interval between the first scan pulse and the second scan pulse of the scan signal applied to the same pixel greater than the default value. In this case, the emission period increases. When the average picture level of the video data RGB is smaller than a preset reference value, the timing controller 11 may generate a duty control signal DCON to decrease the interval between the first scan pulse and the second scan pulse of the scan signal applied to the same pixel to less than the default value. In this case, the emission period decreases.

Figure 4:
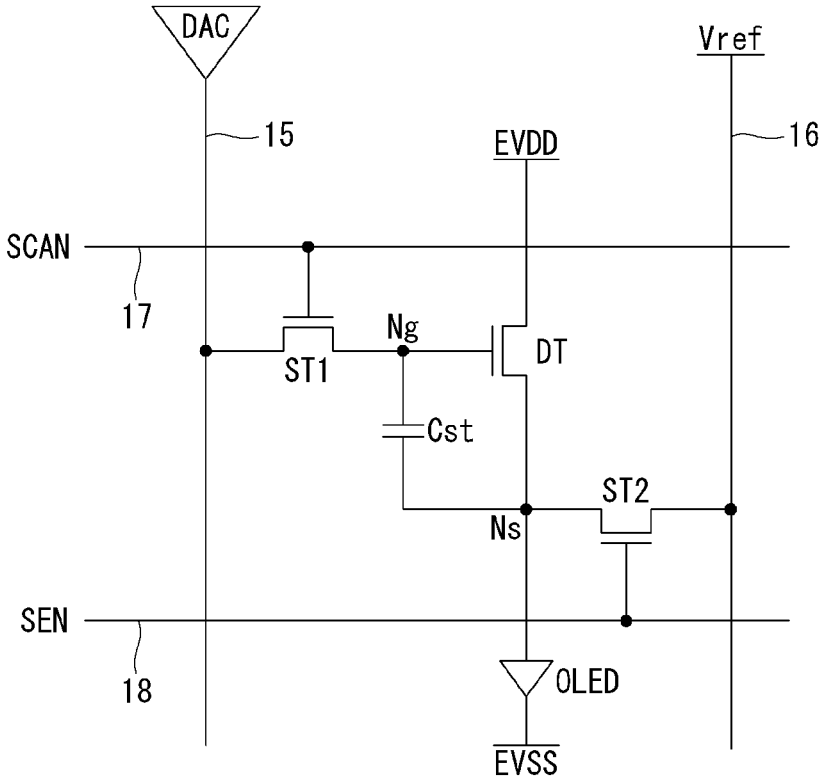
FIG. 4 is a diagram illustrating a pixel configuration for implementing a duty control technique according to an embodiment of the present disclosure.

FIG. 4 is a diagram illustrating a pixel configuration for implementing a duty control technique according to an embodiment of the present disclosure. In FIG. 4, DAC indicates a digital-analog converter in a data driving circuit that outputs a data voltage.

Referring to FIG. 4, a pixel according to an embodiment of the present disclosure may include an OLED, a driving TFT DT, a storage capacitor Cst, a first switching TFT ST1, and a second switching TFT ST2. The pixel according to an embodiment of the present disclosure does not need to further include an emission control TFT ET to implement the duty control technique as in the prior art. Therefore, the pixel configuration is simplified, and luminance distortion due to the operation of the emission control TFT ET is also prevented.

The OLED includes an anode electrode connected to a source node Ns, a cathode electrode connected to an input terminal of a low potential driving voltage EVSS, and an organic compound layer positioned between the anode electrode and the cathode electrode.

The driving TFT DT controls a driving current flowing in the OLED depending on a voltage difference between a gate node Ng and the source node Ns. The driving TFT DT has a gate electrode connected to the gate node Ng, a drain electrode connected to an input terminal of a high potential driving voltage EVDD, and a source electrode connected to the source node Ns. The storage capacitor Cst is connected between the gate node Ng and the source node Ns.

The first switching TFT ST1 switches a current flow between the data line 15 and the gate node Ng in response to a scan signal SCAN. Thus, the first switching TFT ST1 may apply a data voltage on the data line 15 to the gate node Ng. The first switching TFT ST1 has a gate electrode connected to a first gate line 17, a drain electrode connected to the data line 15, and a source electrode connected to the gate node Ng.

The second switching TFT ST2 switches a current flow between a reference line 16 and the source node Ns in response to a sensing signal SEN. Thus, the second switching TFT ST2 may apply a reference voltage Vref on the reference line 16 to the source node Ns. The second switching TFT ST2 has a gate electrode connected to a second gate line 18, a drain electrode connected to the reference line 16, and a source electrode connected to the source node Ns.

Figure 5:
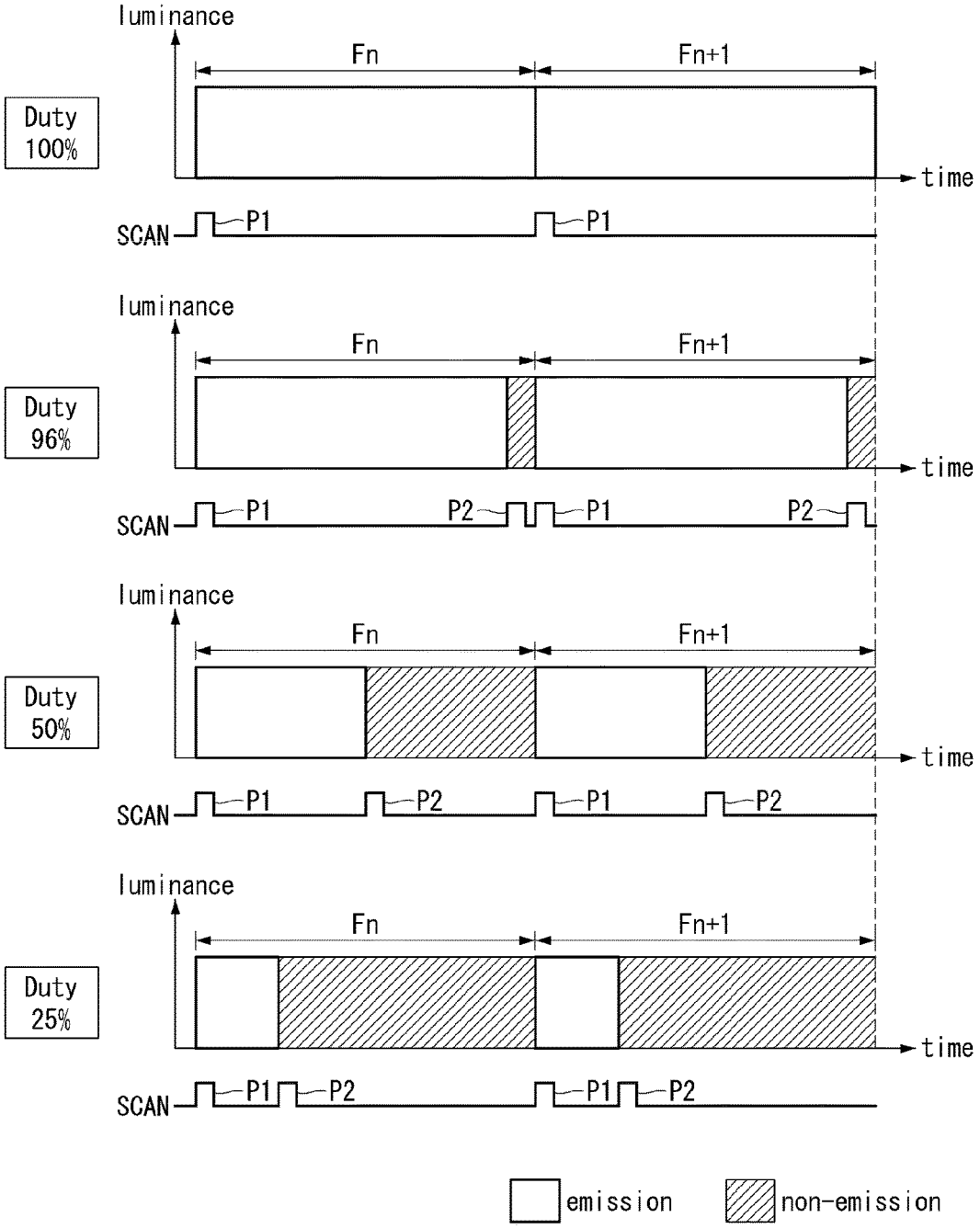
FIG. 5 is a diagram illustrating an example in which an interval between pulses of a gate signal is controlled according to an emission duty.
Figure 6:
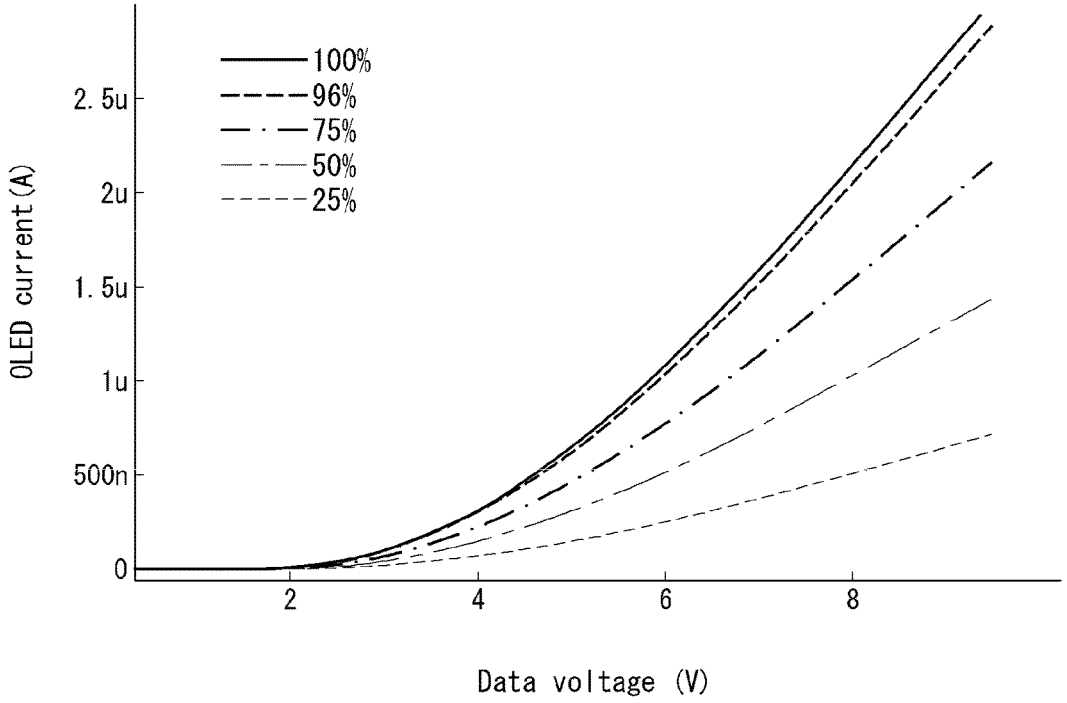
FIG. 6 is a graph illustrating a change of a driving current of an OLED according to an emission duty.

FIG. 5 is an example in which an interval between pulses of a gate signal is controlled according to an emission duty. FIG. 6 is a graph illustrating a change of a driving current of an OLED according to an emission duty.

Referring to FIGS. 5 and 6, the present disclosure adjusts an interval between a first scan pulse P1 and a second scan pulse P2 of a scan signal SCAN continuously applied in one frame for duty driving. Therefore, the present disclosure can control the emission duty of the OLED.

The present disclosure can maintain an emission duty of an OLED at 100% when an inter-frame (Fn, Fn+1) video variation value is small. In this case, the duty driving is not performed, and a scan signal SCAN of a first scan pulse P1 is applied to each pixel during one frame.

The present disclosure performs duty driving only when the inter-frame (Fn, Fn+1) video variation value is large. However, the present disclosure can vary the emission duty of the OLED to 25%, 50%, 96% or the like in proportion to an average picture level of an input video data. In order to implement the duty driving, the present disclosure applies the scan signal SCAN of the first scan pulse P1 and the second scan pulse P2 to each pixel during one frame. An interval between the first scan pulse P1 and the second scan pulse P2 of the scan signal SCAN is proportional to the emission duty of the OLED. As the interval between the first scan pulses P1 and the second scan pulse P2 of the scan signal SCAN decreases, the emission duty of the OLED decreases, but improvement of video response characteristic and low grayscale display quality becomes greater.

Figure 7:
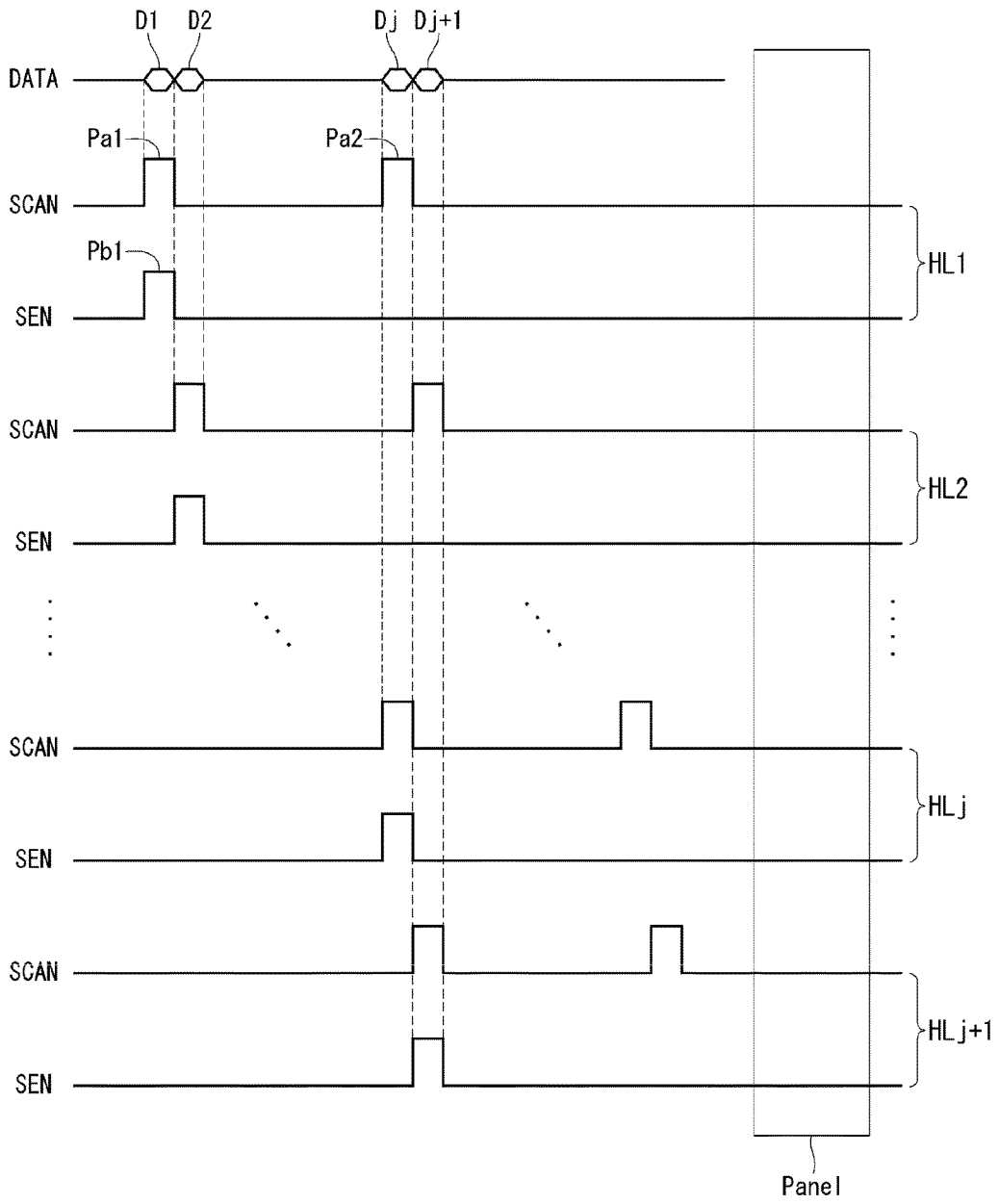
FIGS. 7 and 8 are diagrams illustrating a first embodiment of a driving waveform for implementing a duty control technique according to an embodiment of the present disclosure.
Figure 8:
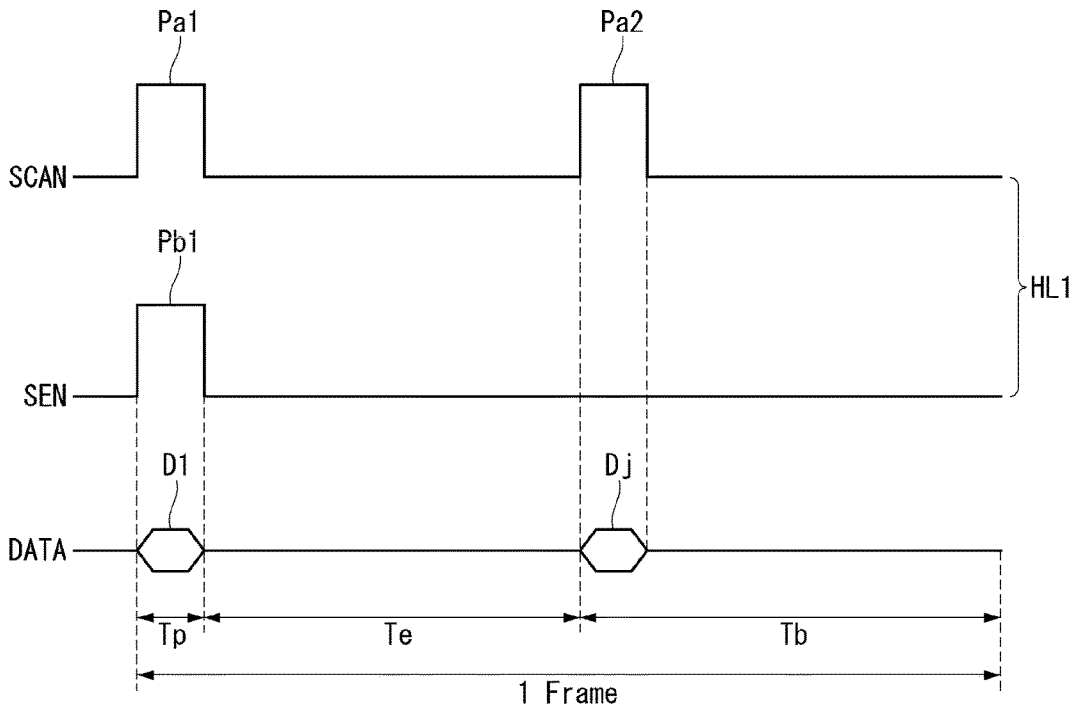
Figure 9A:
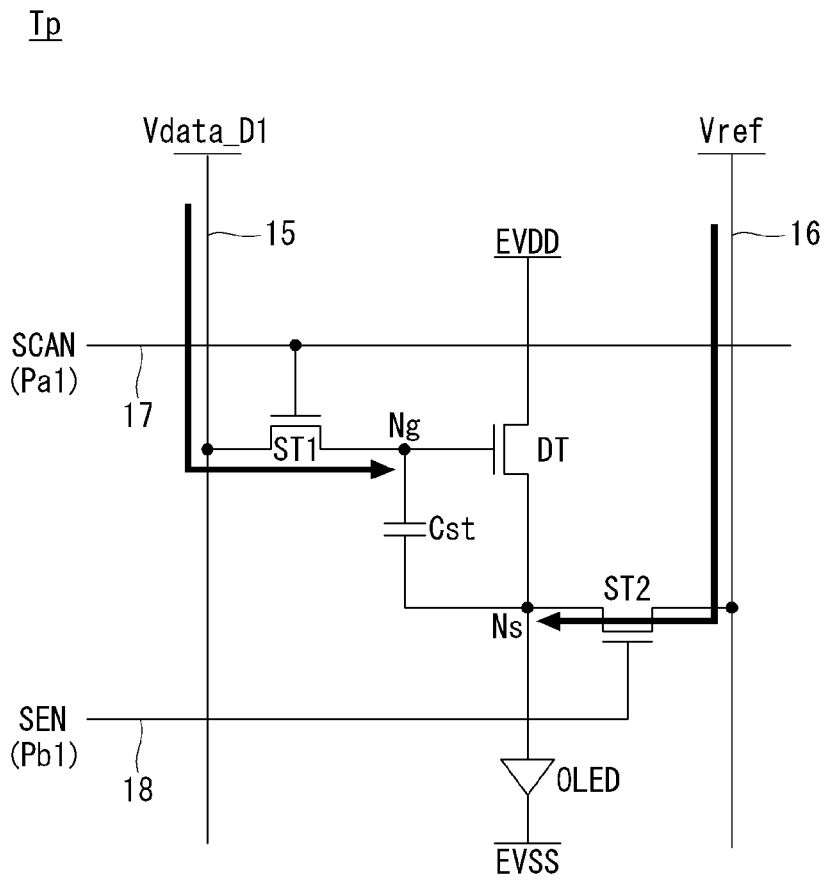
FIG. 9A is an equivalent circuit diagram of a pixel corresponding to a programming period of FIG. 8.
Figure 9B:
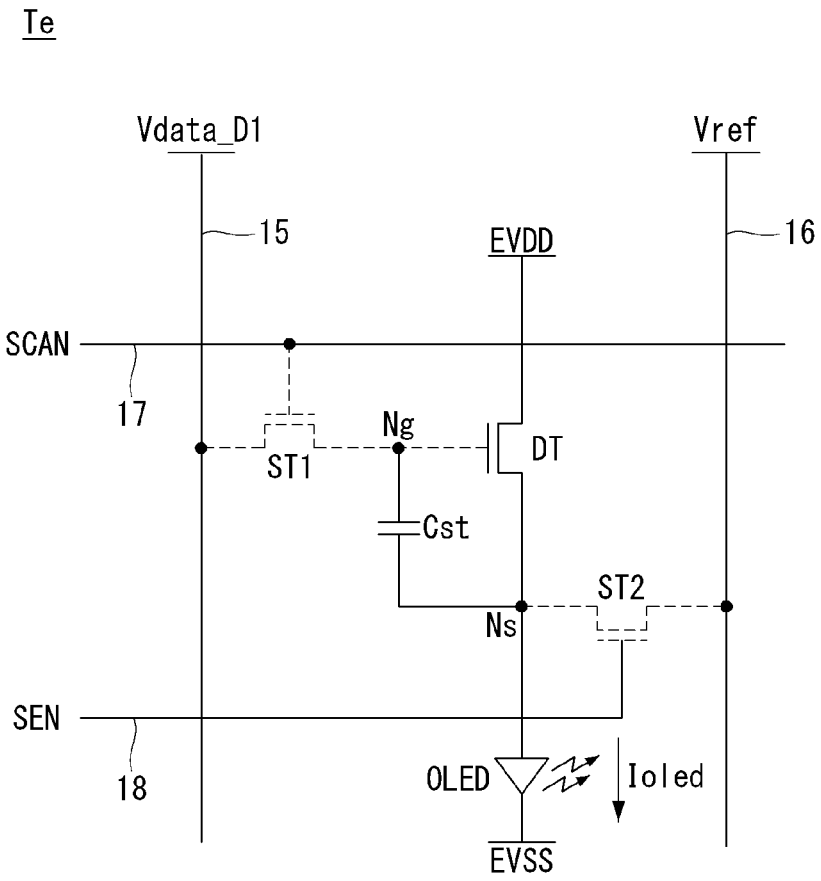
FIG. 9B is an equivalent circuit diagram of a pixel corresponding to an emission period of FIG. 8.
Figure 9C:
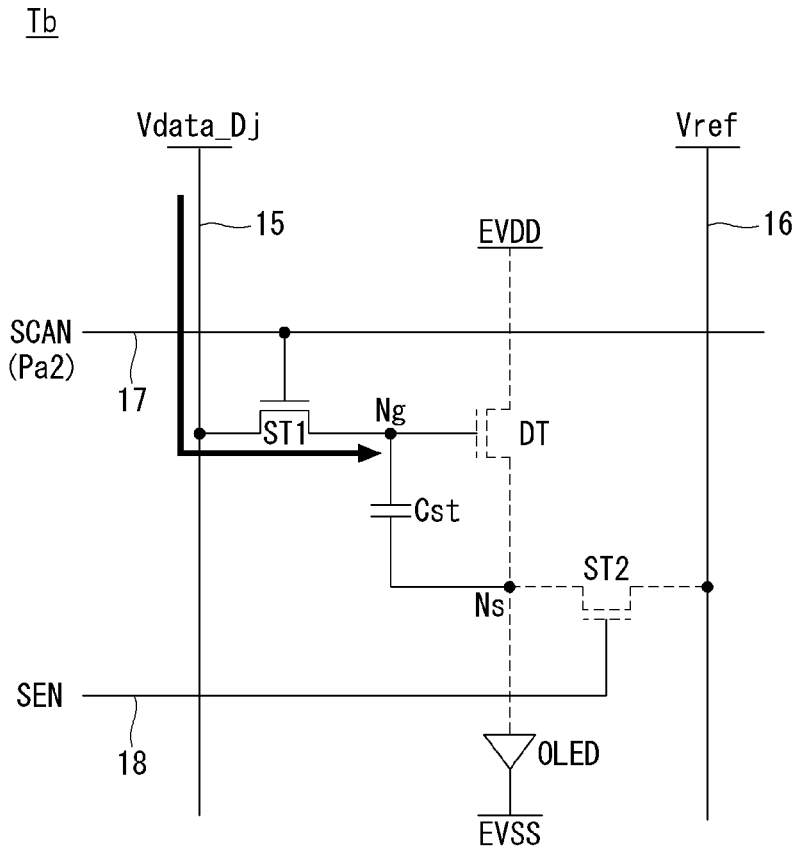
FIG. 9C is an equivalent circuit diagram of a pixel corresponding to a non-emission period of FIG. 8.
Figure 10:
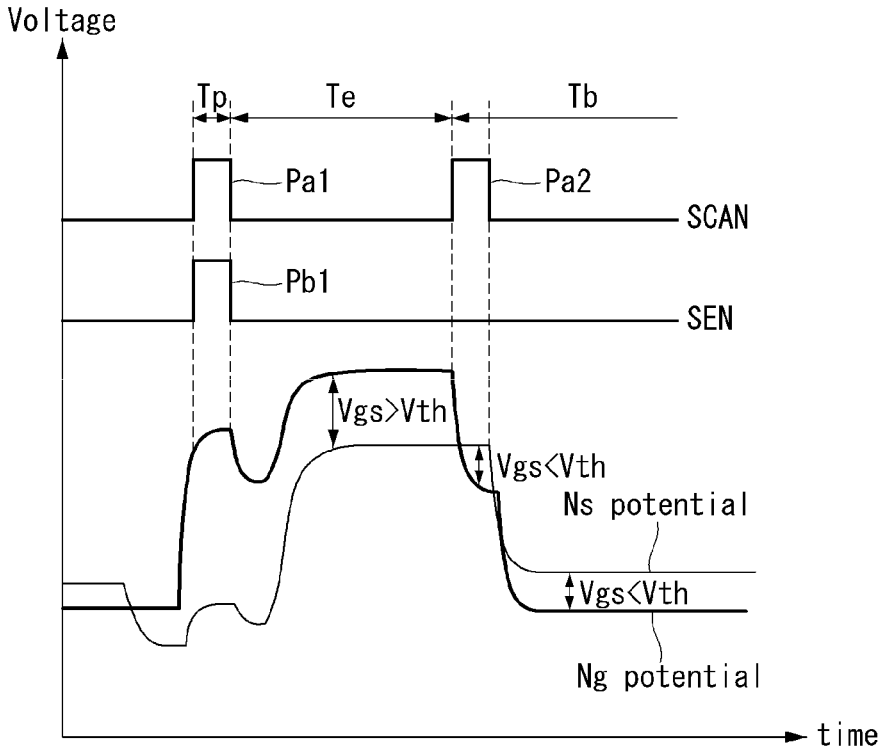
FIG. 10 is a diagram illustrating potentials of a gate node and a source node in a programming period, an emission period, and a non-emission period of FIG. 8.

FIGS. 7 and 8 are a first embodiment of a driving waveform for implementing a duty control technique according to an embodiment of the present disclosure. FIGS. 9A to 9C are equivalent circuit diagrams of pixels corresponding to a programming period, an emission period and a non-emission period, respectively. FIG. 10 illustrates potentials of a gate node and a source node in a programming period, an emission period, and a non-emission period of FIG. 8.

In the first embodiment of the present disclosure, a scan signal SCAN is generated as a double pulse waveform including a first scan pulse Pa1 and a second scan pulse Pa2, and a sensing signal SEN is generated as a single pulse waveform including a first sensing pulse Pb1. FIG. 7 illustrates driving waveforms of pixels sharing the same data line and sharing the same reference line.

Referring to FIG. 7, assuming that a first pixel is arranged in a first horizontal pixel line HL1, a second pixel is arranged in a second horizontal pixel line HL2, a j-th pixel is arranged in a j-th horizontal pixel line HLj, and a (j+1)-th pixel is arranged in a (j+1)-th horizontal pixel line HLj+1, in the same frame, a first data voltage D1 corresponding to a first input video data RGB is applied to the first pixel, a second data voltage D2 corresponding to a second input video data RGB is applied to the second pixel, a j-th data voltage Dj corresponding to a j-th input video data RGB is applied to the j-th pixel, and a (j+1)-th data voltage Dj+1 corresponding to a (j+1)-th input video data RGB is applied to the (j+1)-th pixel. In the same frame, in synchronization with each data voltage D1, D2, Dj, Dj+1, the first scan pulse Pa1 of the scan signal SCAN is applied to the first gate line 17 of each horizontal pixel line HL1 to HLn in a line sequential manner. In synchronization with the first scan pulse Pa1 of the scan signal SCAN, the first sensing pulse Pb1 of the sensing signal SEN is applied to the second gate line 18 of each horizontal pixel line HL1 to HLn in a line sequential manner. In the same frame, in synchronization with each data voltage (Dj, Dj+1, . . . ), the second scan pulse Pa2 of the scan signal SCAN is applied to the first gate line 17 of each horizontal pixel line HL1 to HLn in a line sequential manner.

FIG. 8 illustrates driving waveforms of a scan signal SCAN, a sensing signal SEN and data voltages D1 and Dj applied to a first pixel arranged in a first horizontal pixel line HL1. Referring to FIG. 8, one frame for duty driving includes a programming period Tp for setting a voltage between a gate node Ng and a source node Ns to correspond a driving current, a emission period Te in which an OLED emits light depending on the driving current, and a non-emission period Tb in which the emission of the OLED is stopped.

Referring to FIG. 9A, in a programming period Tp, a first switching TFT ST1 of a first pixel is turned on in response to a first scan pulse Pa1 of a scan signal SCAN to apply a first data voltage D1 to a gate node Ng. In the programming period Tp, a second switching TFT ST2 of the first pixel is turned on in response to a first sensing pulse Pb1 of a sensing signal SEN to apply a reference voltage Vref to a source node Ns. Therefore, in the programming period Tp, a voltage between the gate node Ng and the source node Ns of the first pixel is set to correspond to a driving current.

Referring to FIG. 9B, in an emission period Te, the first switching TFT ST1 of the first pixel is turned off in response to the scan signal SCAN and the second switching TFT ST2 of the first pixel is turned off in response to the sensing signal SEN. The voltage Vgs between the gate node Ng and the source node Ns set in the first pixel in the programming period Tp is also maintained in the emission period Te. Since the voltage Vgs between the gate node Ng and the source node Ns is larger than a threshold voltage Vth of a driving TFT DT of the first pixel as shown in FIG. 10, a driving current flows in the driving TFT of the first pixel during the emission period Te. A potential of the gate node Ng and a potential of the source node Ns are respectively boosted while maintaining the voltage Vgs between the gate node Ng and the source node Ns in the emission period Te by the driving current. When the potential of the source node Ns is boosted to an operating point level of the OLED, the OLED of the first pixel emits light.

Referring to FIG. 9C, in a non-emission period Tb, the first switching TFT ST1 of the first pixel is turned on in response to the second scan pulse Pa2 of the scan signal SCAN to apply the j-th data voltage Dj to the gate node Ng. The second switching TFT ST2 of the first pixel maintains the turn-off state in response to the sensing signal SEN. Here, the j-th data voltage Dj corresponds to an input video data to be applied to the j-th pixel. Since the first pixel and the j-th pixel share one data line and the non-emission period Tb of the first pixel overlaps a programming period of the j-th pixel, the j-th data voltage Dj is applied not only to a gate node of the j-th pixel but also to the gate node Ng of the first pixel.

In the non-emission period Tb, when the j-th data voltage Dj is applied, the potential of the gate node Ng of the first pixel is leveled down to the j-th data voltage Dj from the boosting level and the potential of the source node Ns of the first pixel is maintained at the operating point level of the OLED. In a case of the present disclosure, since the operating point level of the OLED is set to be higher than a maximum data voltage corresponding to the brightest gray-scale, when the j-th data voltage Dj is applied in the non-emission period Tb, the voltage Vgs between the gate node Ng and the source node Ns becomes smaller than the threshold voltage Vth of the driving TFT DT. As a result, the driving current flowing through the driving TFT DT is cut off. Subsequently, in the non-emission period Tb, when a supply of the second scan pulse Pa2 of the scan signal SCAN is stopped, that is, when the second scan pulse Pa2 of the scan signal SCAN is falling, while the voltage Vgs between the gate node Ng and the source node Ns is kept smaller than the threshold voltage Vth of the driving TFT DT, the potential of the gate node Ng and the potential of the source node Ns are leveled down, respectively. When the potential of the source node Ns becomes lower than the operating point level of the OLED, the emission of the OLED is stopped.

Figure 11:
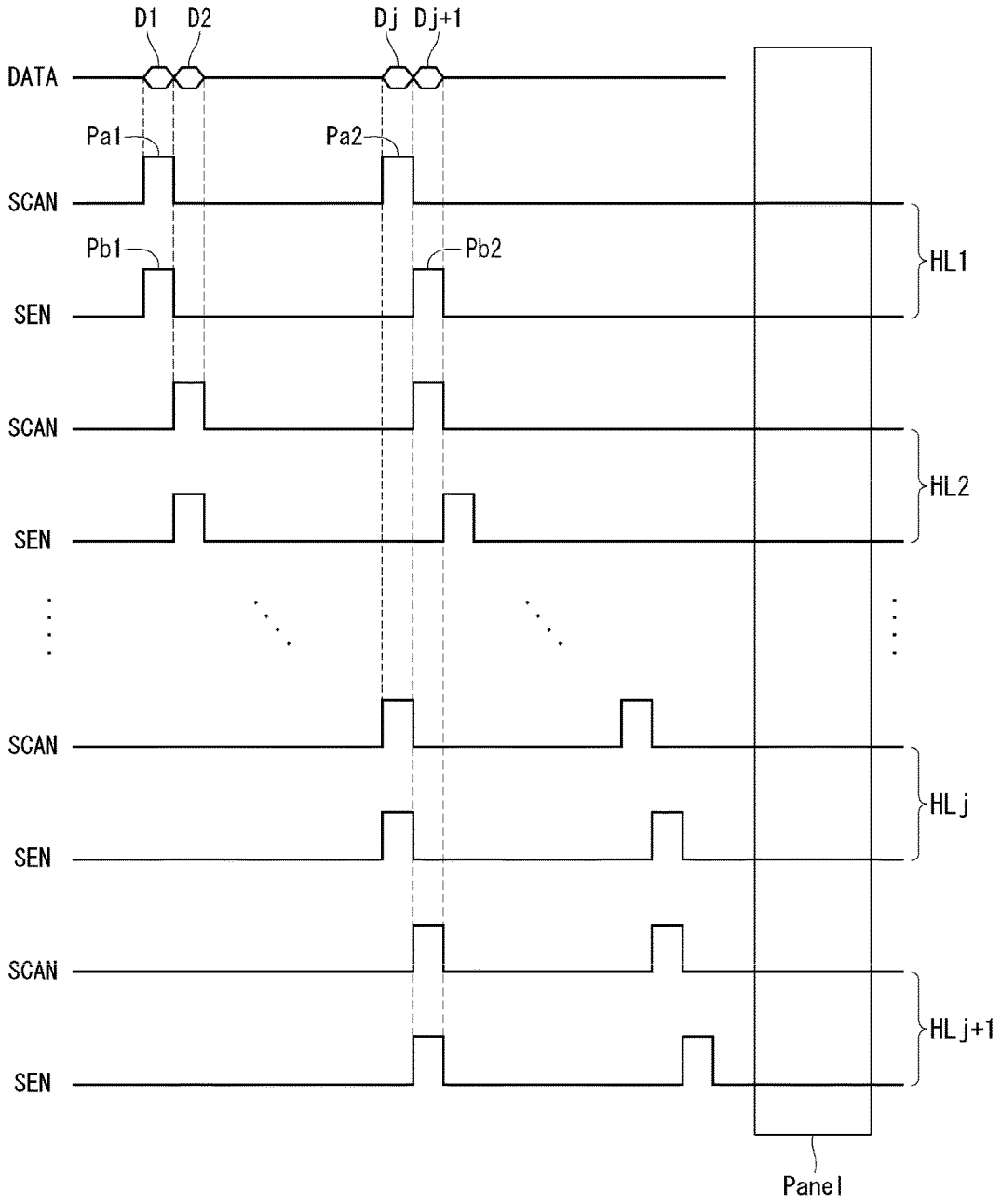
FIGS. 11 and 12 are diagrams illustrating a second embodiment of a driving waveform for implementing a duty control technique according to an embodiment of the present disclosure.
Figure 12:
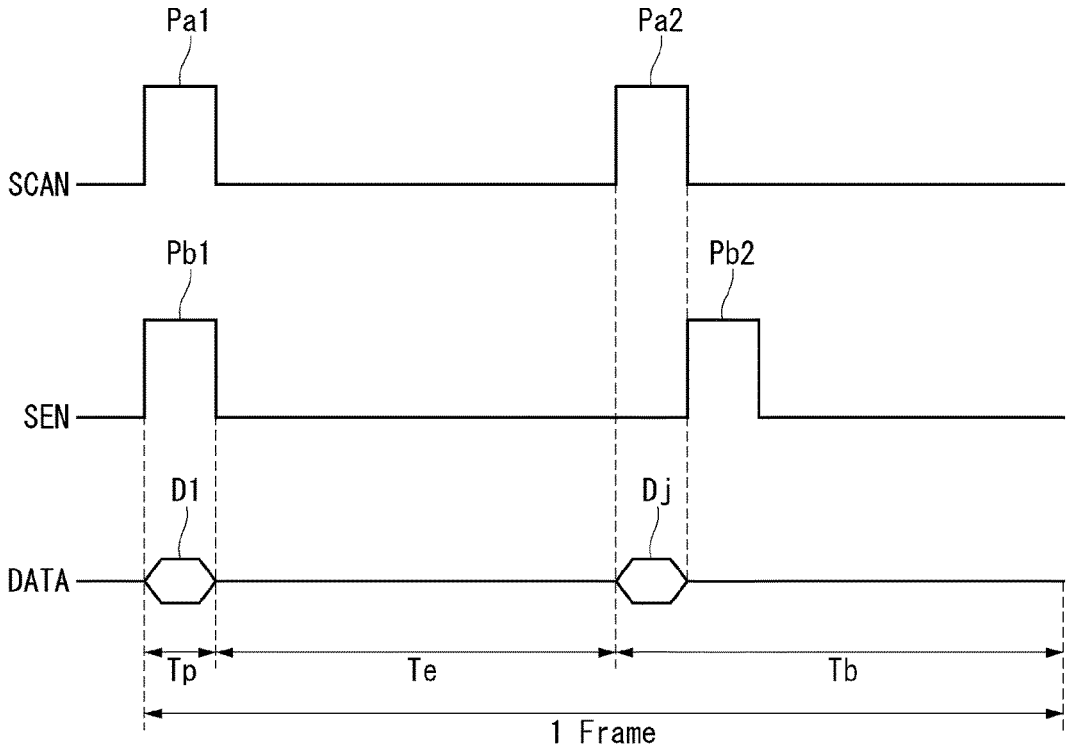
Figure 13A:
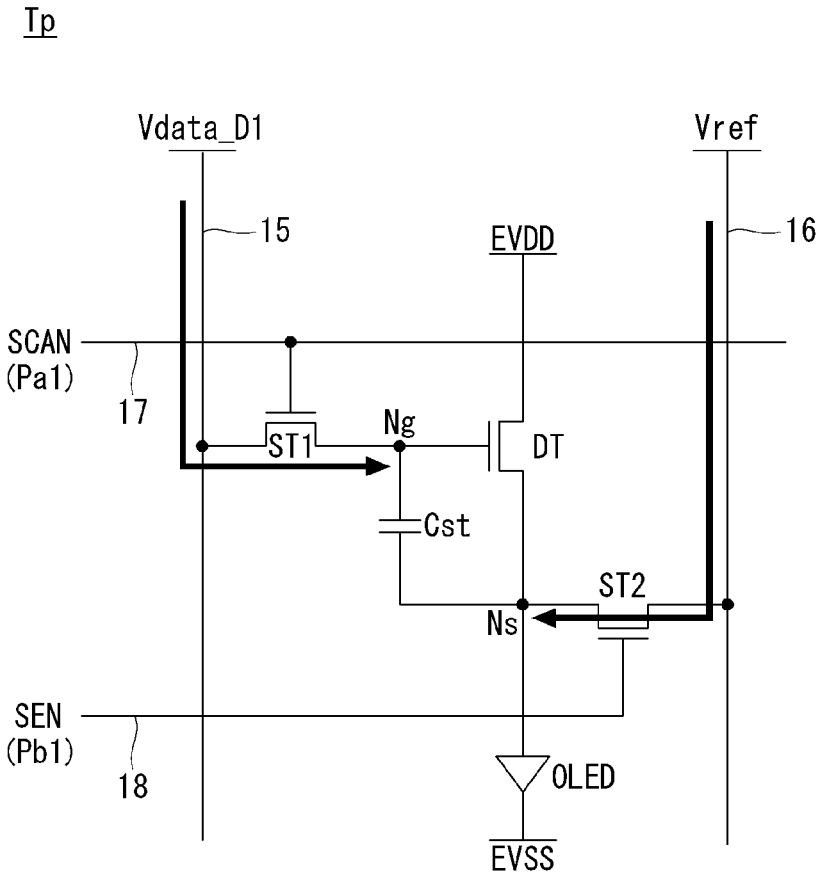
FIG. 13A is an equivalent circuit diagram of a pixel corresponding to a programming period of FIG. 12.
Figure 13B:
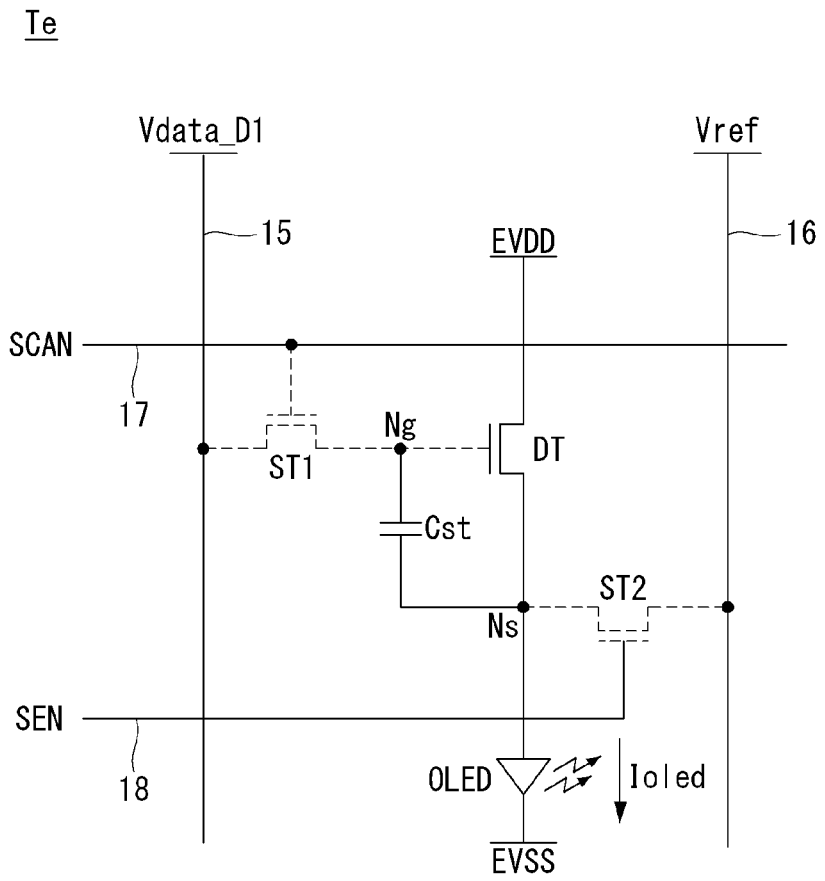
FIG. 13B is an equivalent circuit diagram of a pixel corresponding to an emission period of FIG. 12.
Figure 13C:
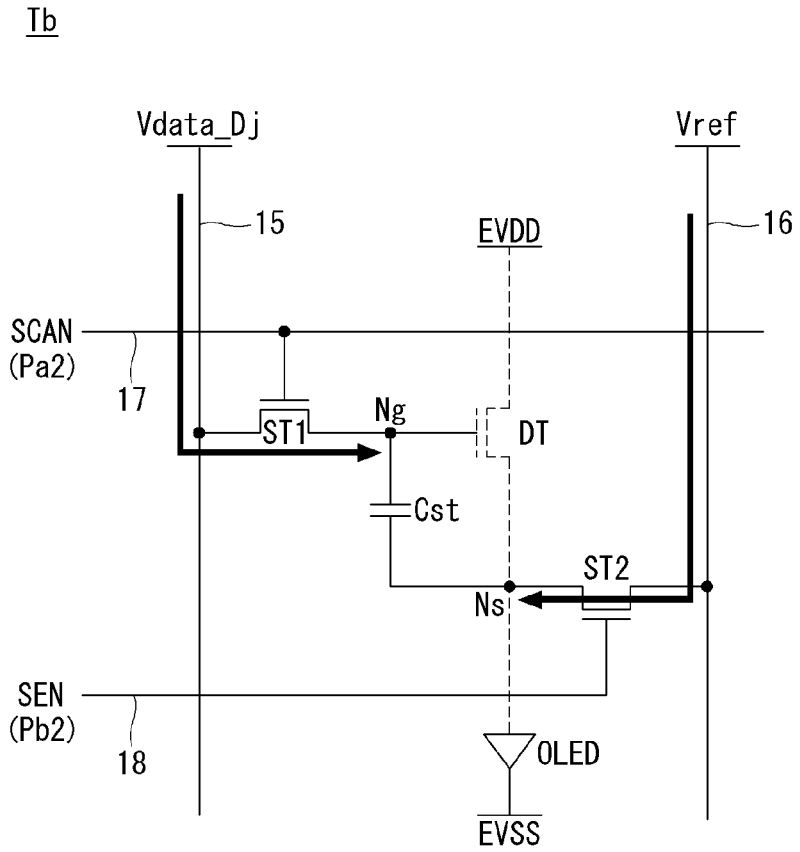
FIG. 13C is an equivalent circuit diagram of a pixel corresponding to a non-emission period of FIG. 12.
Figure 14:
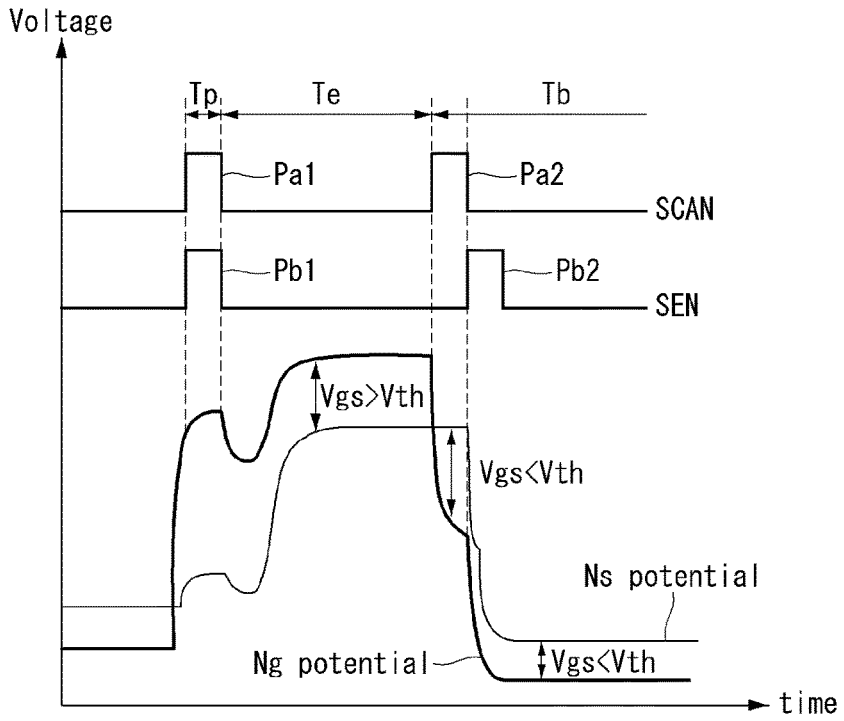
FIG. 14 is a diagram illustrating potentials of a gate node and a source node in a programming period, an emission period, and a non-emission period of FIG. 12.

FIGS. 11 and 12 are a second embodiment of a driving waveform for implementing a duty control technique according to an embodiment of the present disclosure. FIGS. 13A to 13C are equivalent circuit diagrams of pixels corresponding to a programming period, an emission period and a non-emission period, respectively. FIG. 14 illustrates potentials of a gate node and a source node in a programming period, an emission period, and a non-emission period of FIG. 12.

The second embodiment of the present disclosure differs from the first embodiment in that a sensing signal SEN as well as a scan signal SCAN is generated by a double pulse waveform. In the second embodiment of the present disclosure, the scan signal SCAN is generated as a double pulse waveform including a first scan pulse Pa1 and a second scan pulse Pa2, and the sensing signal SEN is generated as a double pulse waveform including a first sensing pulse Pb1 and a second sensing pulse Pb2. If the sensing signal SEN is also generated as the double pulse waveform, it is possible to directly apply a reference voltage Vref to the source node Ns in the non-emission period Tb. Thus, the potential of the source node Ns can be lowered faster than the operating point level of the OLED in order to stop the emission of the OLED.

FIG. 11 illustrates driving waveforms of pixels sharing the same data line and sharing the same reference line. Referring to FIG. 11, assuming that a first pixel is arranged in a first horizontal pixel line HL1, a second pixel is arranged in a second horizontal pixel line HL2, a j-th pixel is arranged in a j-th horizontal pixel line HLj, and a (j+1)-th pixel is arranged in a (j+1)-th horizontal pixel line HLj+1, in the same frame, a first data voltage D1 corresponding to a first input video data RGB is applied to the first pixel, a second data voltage D2 corresponding to a second input video data RGB is applied to the second pixel, a j-th data voltage Dj corresponding to a j-th input video data RGB is applied to the j-th pixel, and a (j+1)-th data voltage Dj+1 corresponding to a (j+1)-th input video data RGB is applied to the (j+1)-th pixel. In the same frame, in synchronization with each data voltage D1, D2, Dj, Dj+1, the first scan pulse Pa1 of the scan signal SCAN is applied to the first gate line 17 of each horizontal pixel line HL1 to HLn in a line sequential manner. In synchronization with the first scan pulse Pa1 of the scan signal SCAN, the first sensing pulse Pb1 of the sensing signal SEN is applied to the second gate line 18 of each horizontal pixel line HL1 to HLn in a line sequential manner. In the same frame, in synchronization with each data voltage (Dj, Dj+1, . . . ), the second scan pulse Pa2 of the scan signal SCAN is applied to the first gate line 17 of each horizontal pixel line HL1 to HLn in a line sequential manner. In synchronization with the second scan pulse Pa2 of the scan signal SCAN, the second sensing pulse Pb2 of the sensing signal SEN is applied to the second gate line 18 of each horizontal pixel line HL1 to HLn in a line sequential manner.

FIG. 12 illustrates driving waveforms of a scan signal SCAN, a sensing signal SEN and data voltages D1 and Dj applied to a first pixel arranged in a first horizontal pixel line HL1. Referring to FIG. 12, one frame for duty driving includes a programming period Tp for setting a voltage between a gate node Ng and a source node Ns to correspond a driving current, a emission period Te in which an OLED emits light depending on the driving current, and a non-emission period Tb in which the emission of the OLED is stopped.

Referring to FIG. 13A, in a programming period Tp, a first switching TFT ST1 of a first pixel is turned on in response to a first scan pulse Pa1 of a scan signal SCAN to apply a first data voltage D1 to a gate node Ng. In the programming period Tp, a second switching TFT ST2 of the first pixel is turned on in response to a first sensing pulse Pb1 of a sensing signal SEN to apply a reference voltage Vref to a source node Ns. Therefore, in the programming period Tp, a voltage between the gate node Ng and the source node Ns of the first pixel is set to correspond to a driving current.

Referring to FIG. 13B, in an emission period Te, the first switching TFT ST1 of the first pixel is turned off in response to the scan signal SCAN and the second switching TFT ST2 of the first pixel is turned off in response to the sensing signal SEN. The voltage Vgs between the gate node Ng and the source node Ns set in the first pixel in the programming period Tp is also maintained in the emission period Te. Since the voltage Vgs between the gate node Ng and the source node Ns is larger than a threshold voltage Vth of a driving TFT DT of the first pixel as shown in FIG. 14, a driving current flows in the driving TFT DT of the first pixel during the emission period Te. A potential of the gate node Ng and a potential of the source node Ns are respectively boosted while maintaining the voltage Vgs between the gate node Ng and the source node Ns in the emission period Te by the driving current. When the potential of the source node Ns is boosted to an operating point level of the OLED, the OLED of the first pixel emits light.

Referring to FIG. 13C, in a non-emission period Tb, the first switching TFT ST1 of the first pixel is turned on in response to the second scan pulse Pa2 of the scan signal SCAN to apply the j-th data voltage Dj to the gate node Ng. Then, the second switching TFT ST2 of the first pixel is turned on in response to the sensing signal SEN to apply the reference voltage Vref to the source node Ns. Here, the j-th data voltage Dj corresponds to an input video data to be applied to the j-th pixel. Since the first pixel and the j-th pixel share one data line and the non-emission period Tb of the first pixel overlaps a programming period of the j-th pixel, the j-th data voltage Dj is applied not only to a gate node of the j-th pixel but also to the gate node Ng of the first pixel.

In the non-emission period Tb, when the j-th data voltage Dj is applied, the potential of the gate node Ng of the first pixel is leveled down to the j-th data voltage Dj from the boosting level and the potential of the source node Ns of the first pixel is maintained at the operating point level of the OLED. In a case of the present disclosure, since the operating point level of the OLED is set to be higher than a maximum data voltage corresponding to the brightest gray-scale, when the j-th data voltage Dj is applied in the non-emission period Tb, the voltage Vgs between the gate node Ng and the source node Ns becomes smaller than the threshold voltage Vth of the driving TFT DT. As a result, the driving current flowing through the driving TFT DT is cut off.

Subsequently, in the non-emission period Tb, when the second scan pulse Pa2 of the scan signal SCAN is falling and, at the same time, the reference voltage Vref is supplied in synchronization with the second scan pulse Pb2 of the sensing signal SEN, while the voltage Vgs between the gate node Ng and the source node Ns is kept smaller than the threshold voltage Vth of the driving TFT DT, the potential of the gate node Ng and the potential of the source node Ns are leveled down, respectively. At this time, since the reference voltage Vref is directly applied to the source node Ns, the potential of the source node Ns becomes lower than the operating point level of the OLED rapidly compared with the coupling effect in the first embodiment. When the potential of the source node Ns becomes lower than the operating point level of the OLED, the emission of the OLED is stopped.

Figure 15:
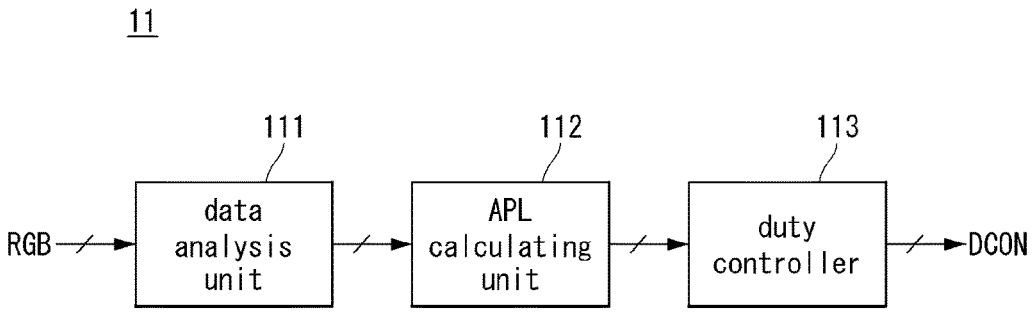
FIG. 15 is a diagram illustrating a configuration of a timing controller for implementing a duty control technique according to an embodiment of the present disclosure.
Figure 16:
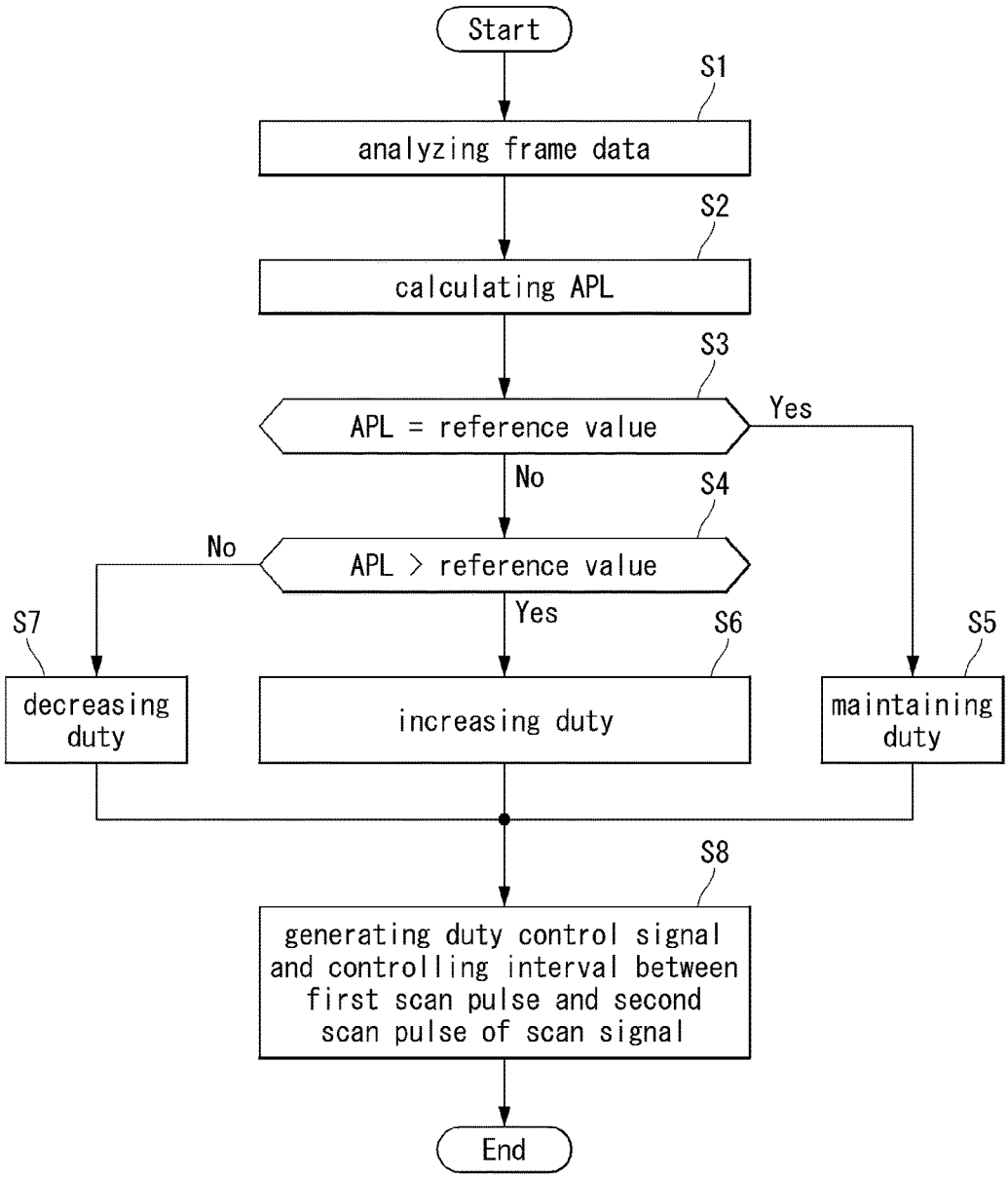
FIG. 16 is a flowchart illustrating one operation procedure of a timing controller for implementing a duty control technique according to an embodiment of the present disclosure.
Figure 17:
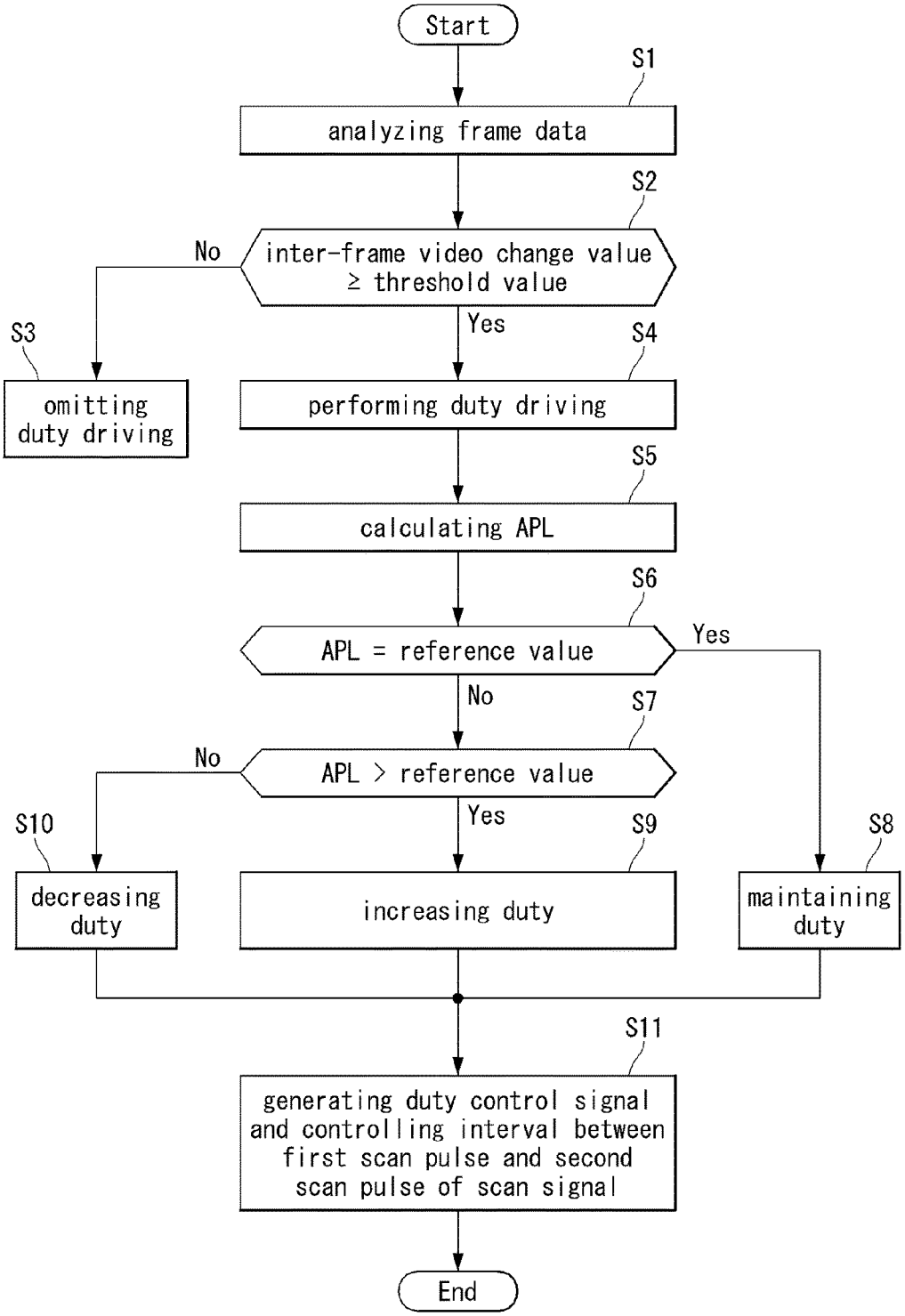
FIG. 17 is a flowchart illustrating another operation procedure of a timing controller for implementing a duty control technique according to an embodiment of the present disclosure.

FIG. 15 is a configuration diagram of a timing controller for implementing a duty control technique according to an embodiment of the present disclosure. FIGS. 16 and 17 are flowcharts illustrating one operation procedure of a timing controller for implementing a duty control technique according to an embodiment of the present disclosure.

Referring to FIGS. 15 to 17, a timing controller 11 according to an embodiment of the present disclosure includes a data analysis unit 111, an APL calculating unit 112 and a duty controller 113 to implement a duty control technique.

The data analysis unit 111 may analyze input video data RGB of a predetermined amount (for example, one frame amount) through various known video analysis techniques (S1).

The APL calculating unit 112 may calculate an average picture level (APL) based on the analyzed result of the video data (S2 of FIG. 16). The APL calculating unit 112 calculates an APL indicating the number of pixels having a peak luminance in one frame from the input video data RGB. That is, the APL calculating unit 112 calculates an APL indicating an area occupied by white pixels in one screen.

The duty controller 113 compares the calculated APL with a preset reference value. The duty controller 113 may control an interval between a first scan pulse and a second scan pulse of a scan signal to control an emission duty of an OLED based on the comparison result (S3 to S8 of FIG. 16).

Specifically, when the calculated APL is equal to the reference value, the duty controller 113 may generate a duty control signal to maintain the interval between the first scan pulse and the second scan pulse of the scan signal (i.e., the emission duty) at a default value (S3 and S5 of FIG. 16).

When the calculated APL is larger than the reference value, the duty controller 113 may generate a duty control signal to increase the interval between the first scan pulse and the second scan pulse of the scan signal (i.e., the emission duty) to a value greater than the default value (S4 and S6 of FIG. 16).

When the calculated APL is smaller than the reference value, the duty controller 113 may generate a duty control signal to decrease the interval between the first scan pulse and the second scan pulse of the scan signal (i.e., the emission duty) to a value less than the default value (S4 and S7 of FIG. 16).

On the other hand, the duty controller 113 compares the calculated APL with a preset reference value, and further may control an interval between a first sensing pulse and a second sensing pulse of a sensing signal to control an emission duty of an OLED based on the comparison result.

FIG. 17 is a flowchart illustrating another operation procedure of a timing controller for implementing a duty control technique according to an embodiment of the present disclosure. Some steps of FIG. 17 are the same as or similar to corresponding some steps of FIG. 16. However, as shown in FIG. 17, as a variation, the timing controller 11 according to an embodiment of the present disclosure performs duty driving only when an inter-frame video variation value based on the analyzed result of the video data is equal to or greater than a threshold value as shown in FIG. 17. For instance, as shown in steps S2 and S3 of FIG. 17, the duty driving is omitted when the inter-frame video variation value is determined to be less than the threshold value, whereas as shown in steps S2 and S4 of FIG. 17, the duty driving is performed when the inter-frame video variation value is determined to be greater than or equal to the threshold value. Accordingly, the present disclosure can reduce unnecessary power consumption by omitting duty driving for a still image or a video close to the still image in which the video response characteristic is not a problem.

As described above, the present disclosure can easily adjust the non-emission period in which the emission of the OLED stops in one frame by appropriately controlling the scan signal or the scan signal and the sensing signal without programming the black data that can turn off the driving TFT. According to the present disclosure, it is not necessary to write black data for duty driving, so that it is possible to prevent an increase in power consumption due to black data writing in advance.

Furthermore, since the present disclosure eliminates the necessity of further providing an emission control TFT for duty driving, the present disclosure can simplify the pixel configuration, and can prevent luminance distortion due to the operation of the emission control TFT in advance.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display capable of duty driving for controlling an emission duty of an organic light emitting diode (OLED) in one frame, the organic light emitting diode display comprising:

a display panel having a plurality of pixels connected to a data line, a reference line, and a gate line, each pixel including an OLED and a driving thin film transistor (TFT) for controlling a driving current flowing in the OLED depending on a voltage between a gate node and a source node;

a data driving circuit configured to supply a data voltage to the data line and supply a reference voltage to the reference line; and a gate driving circuit configured to generate a scan signal synchronized with the data voltage and a sensing signal synchronized with the reference voltage, and supply the generated scan signal and sensing signal to corresponding gate lines, respectively, wherein one frame for the duty driving includes a programming period for setting the voltage between the gate node and the source node to correspond the driving current, an emission period in which the OLED emits light depending on the driving current, and a non-emission period in which the emission of the OLED stops, wherein in the programming period, a first data voltage is applied to the gate node in response to the scan signal and the reference voltage is applied to the source node in response to the sensing signal, wherein in the non-emission period, a second data voltage is applied to the gate node in response to the scan signal, wherein the first data voltage corresponds to input video data to be applied to a first pixel, wherein the second data voltage corresponds to input video data to be applied to a second pixel different from the first pixel, and wherein the scan signal includes a first scan pulse synchronized with the first data voltage and a second scan pulse synchronized with the second data voltage, and the first scan pulse and the second scan pulse are both applied to a same gate line of the first pixel during the one frame.

2. The organic light emitting diode display of claim 1, wherein the second pixel shares the data line with the first pixel.

3. The organic light emitting diode display of claim 1, wherein each of the pixels further includes:

a storage capacitor connected between the gate node and the source node, a first switching TFT having a gate electrode connected to a first gate line and switching a current flow between the data line and the gate node in response to the scan signal, and a second switching TFT having a gate electrode connected to a second gate line and switching a current flow between the reference line and the source node in response to the sensing signal, wherein the sensing signal includes a first sensing pulse synchronized with the first scan pulse.

4. The organic light emitting diode display of claim 3, wherein in the non-emission period, the reference voltage is further applied to the source node in response to the sensing signal, and wherein the sensing signal further includes a second sensing pulse subsequent to the second scan pulse.

5. The organic light emitting diode display of claim 4, further comprising:

a data analysis unit configured to analyze a predetermined amount of input video data;

an average picture level (APL) calculating unit configured to calculate an average picture level based on the analyzed result of the video data; and a duty controller configured to compare the calculated APL with a preset reference value and control an interval between the first scan pulse and the second scan pulse to control the emission duty of the OLED based on the comparison result.

6. The organic light emitting diode display of claim 5, wherein when the calculated APL is equal to the reference value, the duty controller is configured to generate a duty control signal to maintain the interval between the first scan pulse and the second scan pulse at a default value, when the calculated APL is larger than the reference value, the duty controller is configured to generate a duty control signal to increase the interval between the first scan pulse and the second scan pulse to a value greater than the default value, when the calculated APL is smaller than the reference value, the duty controller is configured to generate a duty control signal to decrease the interval between the first scan pulse and the second scan pulse to a value less than the default value.

7. The organic light emitting diode display of claim 5, wherein the duty driving is performed only when an inter-frame video variation value based on the analyzed result of the video data is equal to or greater than a threshold value.

8. A method of driving an organic light emitting diode display having an organic light emitting diode (OLED), a driving thin film transistor (TFT) for controlling a driving current flowing in the OLED depending on a voltage between a gate node and a source node, and a plurality of pixels connected to a data line, a reference line, and a gate line, the organic light emitting diode display capable of duty driving for controlling an emission duty of the OLED in one frame, the method comprising:

supplying a data voltage to the data line and supplying a reference voltage to the reference line; and generating a scan signal synchronized with the data voltage and a sensing signal synchronized with the reference voltage and supplying the generated scan signal and sensing signal to corresponding gate lines, respectively, wherein one frame for the duty driving includes a programming period for setting the voltage between the gate node and the source node to correspond the driving current, an emission period in which the OLED emits light depending on the driving current, and a non-emission period in which the emission of the OLED stops, wherein in the programming period, a first data voltage is applied to the gate node in response to the scan signal and the reference voltage is applied to the source node in response to the sensing signal, wherein in the non-emission period, a second data voltage is applied to the gate node in response to the scan signal, wherein the first data voltage corresponds to input video data to be applied to a first pixel, wherein the second data voltage corresponds to input video data to be applied to a second pixel different from the first pixel, and wherein the scan signal includes a first scan pulse synchronized with the first data voltage and a second scan pulse synchronized with the second data voltage, and the first scan pulse and the second scan pulse are both applied to a same gate line of the first pixel during the one frame.

9. The method of claim 8, wherein the second pixel shares the data line with the first pixel.

10. The method of claim 8, wherein the sensing signal includes a first sensing pulse synchronized with the first scan pulse.

11. The method of claim 10, wherein in the non-emission period, the reference voltage is further applied to the source node in response to the sensing signal, and wherein the sensing signal further includes a second sensing pulse subsequent to the second scan pulse.

12. The method of claim 11, further comprising:

analyzing a predetermined amount of input video data;

calculating an average picture level (APL) based on the analyzed result of the video data; and comparing the calculated APL with a preset reference value and controlling an interval between the first scan pulse and the second scan pulse to control the emission duty of the OLED based on the comparison result.

13. The method of claim 12, wherein the controlling the interval between the first scan pulse and the second scan pulse includes:

when the calculated APL is equal to the reference value, generating a duty control signal and maintaining the interval between the first scan pulse and the second scan pulse at a default value, when the calculated APL is larger than the reference value, generating a duty control signal and increasing the interval between the first scan pulse and the second scan pulse to a value greater than the default value, and when the calculated APL is smaller than the reference value, generating a duty control signal and decreasing the interval between the first scan pulse and the second scan pulse to a value less than the default value.

14. The method of claim 12, wherein the duty driving is performed only when an inter-frame video variation value based on the analyzed result of the video data is equal to or greater than a threshold value.

* * * * *